United States Patent [19]

Hartmann

[11] 4,190,101

[45] Feb. 26, 1980

[54] HEAT EXCHANGER TUBE BASE

[75] Inventor: Werner Hartmann, Immenstaad, Fed. Rep. of Germany

[73] Assignee: Swakopmund AG, Diesbach, Switzerland

[21] Appl. No.: 780,067

[22] Filed: Mar. 22, 1977

[30] Foreign Application Priority Data

Mar. 24, 1976 [DE] Fed. Rep. of Germany ..... 2612514

[51] Int. Cl.[2] ..... F28F 9/02

[52] U.S. Cl. ..... 165/82; 165/158; 165/176; 165/DIG. 8; 156/296

[58] Field of Search ..... 165/DIG. 8, 180, 173, 165/175, 178, 79, 82, 176, 69, 158; 29/157.4; 156/293, 296

[56] References Cited

U.S. PATENT DOCUMENTS

| | | | |
|---|---|---|---|
| 1,868,661 | 7/1932 | Heimberger | 165/176 |
| 2,056,920 | 10/1936 | Demann | 165/178 |
| 2,839,276 | 6/1958 | Rossi | 165/176 |
| 3,426,841 | 2/1969 | Johnson | 165/178 |
| 3,489,209 | 1/1970 | Johnson | 165/180 |
| 3,633,660 | 1/1972 | Young | 165/173 |
| 3,993,126 | 11/1976 | Taylor | 165/173 |
| 4,117,884 | 10/1978 | Frei | 29/157.4 |

FOREIGN PATENT DOCUMENTS

| | | | |
|---|---|---|---|
| 956505 | 2/1950 | France | 165/175 |
| 431520 | 7/1935 | United Kingdom | 165/DIG. 8 |
| 1040284 | 8/1966 | United Kingdom | 165/173 |

*Primary Examiner*—Sheldon Jay Richter
*Attorney, Agent, or Firm*—Tab T. Thein

[57] ABSTRACT

Improved tube bundle-type heat exchanger comprising at least one tube base cast from a plastic material, such as poly laurin lactam, with a tube bundle cast in the tube base. Several optional features are also disclosed.

4 Claims, 2 Drawing Figures

HEAT EXCHANGER TUBE BASE

Figure 1:
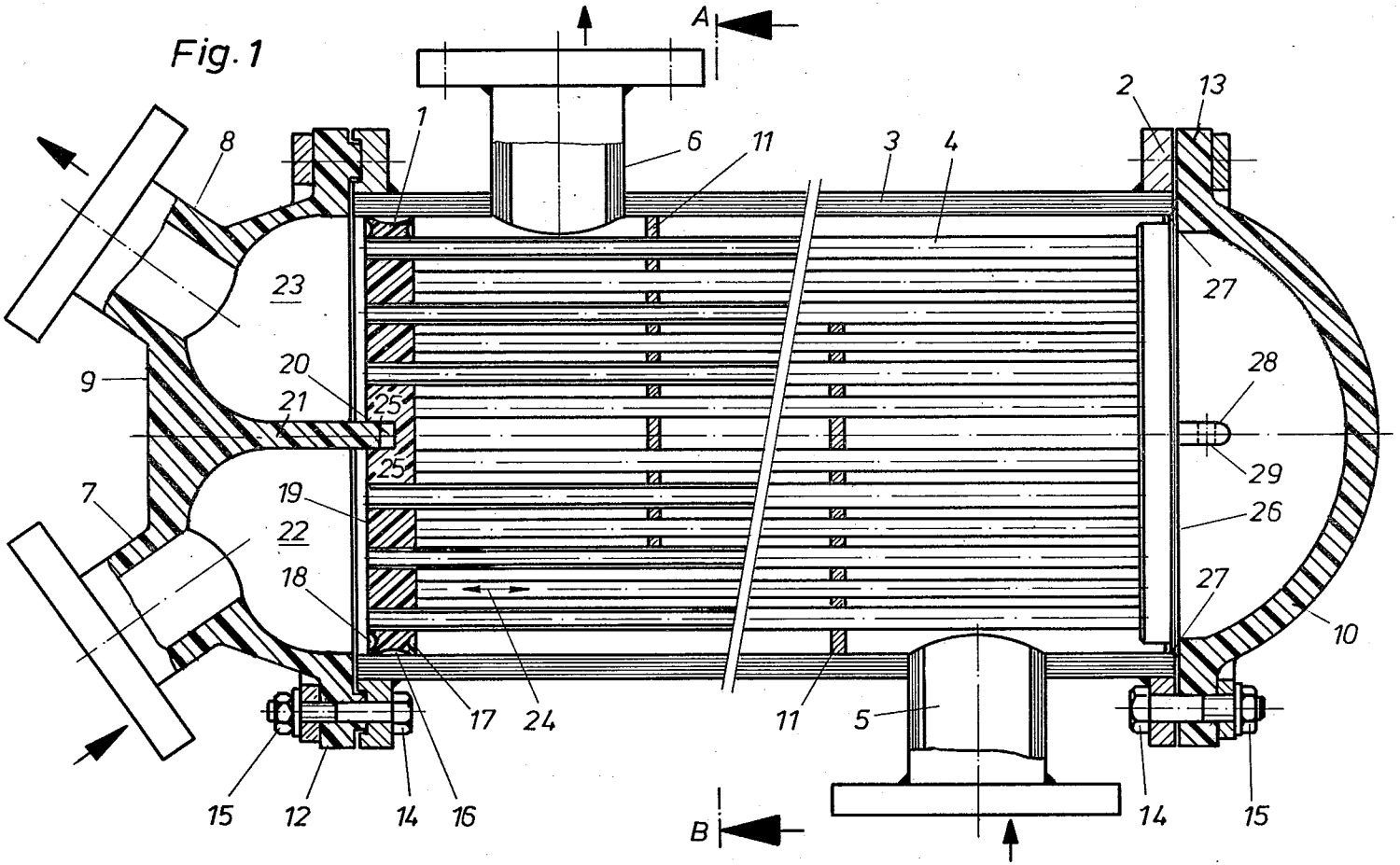

This invention relates to improvements in heat exchangers having tube bases with inner tubes in the form of a tube bundle that is cast in at one end.

Such tube bases are to hold the inner tubes of a tube-bundle type heat exchanger. Different types of such heat exchangers are known wherein each heat exchanger has at least one such tube base for holding the inner tubes. Three main types are distinguishable, namely heat exchangers with fixed tube bases, those with U-shaped tubes, and heat exchangers with floating heads.

With all these heat exchangers there is the problem that the tube base(s) tend(s) to unevenness after a certain use because of thermal changes in length that occur in operation. An attempt has been made to avoid this in that the tube bundle was cast in a copper coating or a coating of a tin-lead alloy, the cast metal coat forming however irregular shapes after solidifying, whereby additional measures must be taken so that the liquid metal cannot pass into the tubes.

This solution is not satisfactory because, due to diverging heat-expansion coefficients of the material from which the tubes and other structure of the heat exchanger are made, on the one hand, and of the material from which the tube bases are made, on the other hand, ageing and seating problems still occur after a certain period of use. It should be mentioned that such heat exchangers are subjected in operation to frequent heat cycles.

The invention has as its object to obviate these drawbacks. It is based on the use of a tube base (or bases) with inner tubes of a tube-bundle type cast in at least at one end, the heat exchanger being characterized by long life with satisfactory sealing properties. For the solution of this problem the invention provides that the plastic tube base(s) consist(s) of poly laurin lactam.

With the use of this organic material the described problems are completely obviated. This material has a higher thermal expansion coefficient than the bundle of tubes and the other constructional parts of the heat exchanger. In addition this material withstands all other loads and attacks, even of a chemical nature, to which such a heat exchanger is subjected in operation. With an increasing temperature of the tube base, the material expands more than the remaining heat-exchanger tubes and thus presses the bundle of inserted tubes with a still higher pressure. The same applies to the pressure prevailing between the tube base(s) and the housing casing of the heat exchanger.

The closeness between the tube base and the casing is increased if, according to the invention, the tube base being made of a plastic material, the covering face of the tube base for the forming of one or more sealing edges is curved by the tube base itself or is profiled.

By this measure sufficient space is provided between the sealing edge of the tube base and the casing of the heat exchanger, which space can take up the material of the tube base on temperature increase, that is on a corresponding expansion of the tube base. Because of its good elastic properties the tube base re-assumes its original profile without trouble when temperature is reduced.

The profiling of the sealing edge is arranged so that the face of the tube base is curved, preferably approximately in the middle of it thickness.

It is suggested to employ two sealing edges that run around the tube base and are spaced apart from one another. A self-centering of the tube base thus results upon thermal working.

One or both tube bases may have on its (their) outer face(s) a recess for a central flange of a hood for the heat exchanger.

As a further optional, useful feature, the tube base may have on its periphery an outwardly projecting shoulder with a conical sealing face.

Finally, the invention also provides that the tube base may have a tongue on its outer face, as will be explained in more detail hereunder.

Figure 2:
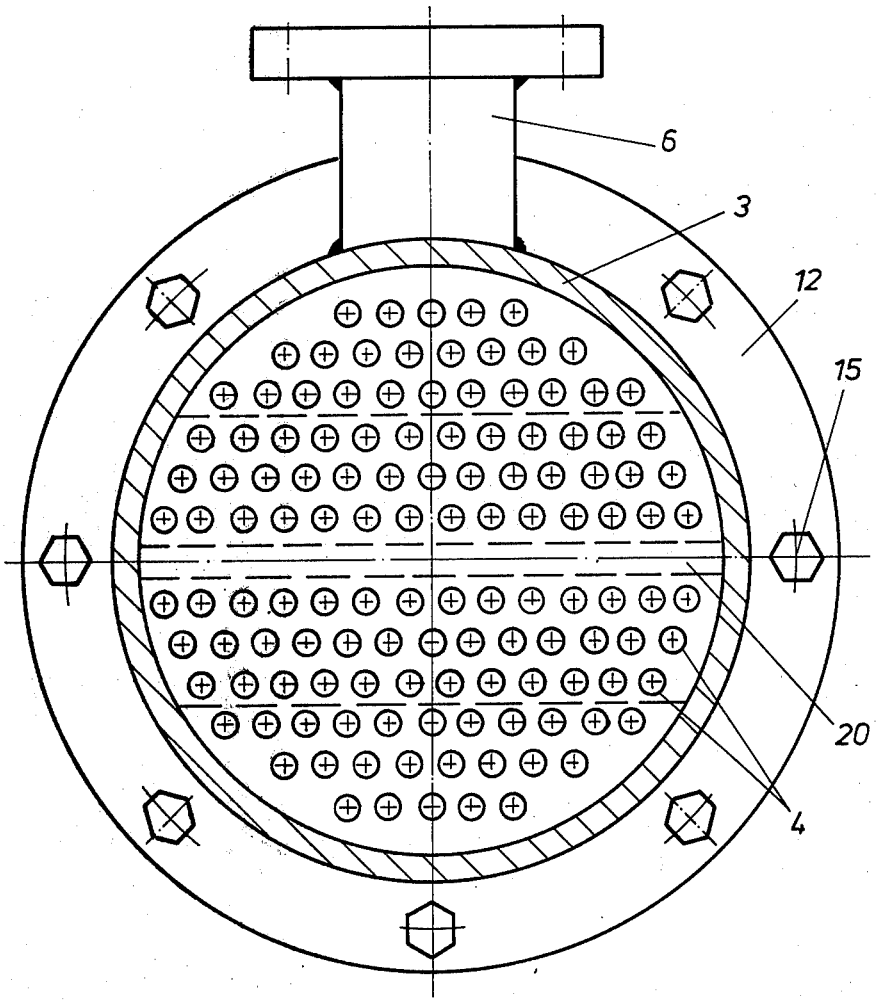

The invention will become better understood from the following detailed description, when considered together with the accompanying drawings, wherein FIG. 1 shows a longitudinal section through a tube-bundle type heat exchanger with two tube bases according to the present invention; and FIG. 2 is a section along line A–B of FIG. 1.

First of all the basic construction of the illustrated tube bundle should be explained. The heat exchanger has in the illustrated embodiment two tube bases or end supports 1, 2 cast preferably of plastic, such as poly laurin lactam. The heat exchanger has a conventional housing casing 3, a tube bundle 4 between the bases 1, 2, a casing connection 5 for the inlet of a first fluid, a casing member 6 for the outlet of this fluid, a hood connection member 7 for the inlet of a second fluid, another such member 8 for the outlet of this second fluid, a first hood 9 carrying the members 7, 8, a second hood 10 on the opposite end of the heat exchanger, transverse plates 11 inside the casing 3, and respective hood flanges 12, 13 on the hoods 9, 10 for securing the latter to the casing 3 by means of bolts 14 with nuts 15.

The tube bases 1, 2 consist of poly laurin lactam or a plastic material with the same or similar properties. The tubes 4 are connected to the tube bases 1, 2 so that they are inserted in a chamber or receptacle, open at the top, by means of a suitable holding means in the configurations shown. Previously the lower ends of the inner tubes 4 have been closed by suitable stoppers, or these tubes are placed on the very bottom of the chamber so that no liquid can enter the tubes through the gaps between the ends of the tubes and the bottom of the chamber.

In a further step the plastic material, e.g. poly laurin lactam, is cast by melting in the chamber. The material is a very thin liquid that flows practically like water. It hardens after a short time, for example, about 60 seconds. The chamber is then removed and one of the tube bases, e.g. 1, made by means of the hardened plastic material, is turned on its casing face. The ends of the inner tubes need only to be free of grease. They need not be roughened in order to have a particularly good embedding as in the case with conventional manufacturing methods. They also do not need to be bent up at their ends. On the contrary tubes can be used that are conventionally cut at their ends.

The thermal expansion coefficients of the conventional tube material (poly laurin lactam) and of the special plastic material are such that with increasing temperature pressure continually increases between the tube base(s) and the ends of the tubes embedded therein. This stronger pressure also occurs in respect of the inner wall of the casing cover 3 of the heat exchanger so that the usual sealing problems are eliminated.

The other tube base, e.g. 2, is made in a similar manner, as described, for which the tube bundle 4 with the completed first tube base 1 is reversed.

FIG. 1 shows that the first tube base 1 has a peripherial curvature 16 whereby two sealing edges 17, 18 are formed with which the base contacts the inner wall of the casing 3. Furthermore the tube base 1 may have on its outer face 19 an approximately central receiver or recess 20 for a central flange 21 of the hood 9. Thus a double-chamber feed with part chambers 22, 23 is provided for the second fluid because the central flange 21, with thermal movement of the tube bundle 4 in the direction of a double arrow 24, forms a seal with groove faces 25 of the receiver 20.

The second tube base 2 has at the transition from an outer face 26 to a covering face a conically widening annular shoulder 27 which touches the front of the cover 3 with a conical chamfer. The flange 13 of the hood 10 presses from outside onto the resilient material of the tube base 2 to form a seal with the cone.

In addition this tube base 2 may also have a tongue 28 with a hold 29 for raising the tube base.

For improving heat conduction, metal pieces may also be embedded in the tube bases 1, 2. The plastic material of which the tube bases consist has an elastic return capacity up to about 80%. No permanent deformation of the tube bases occurs therfore in operation. The plastic material is resistant to practically all aggressive media including formic acid. It is however essential for the crystalline portion to amount to about 71%. The crystals are not directly embedded in an amorphous structure but extend through the phases over the whole length. Thus the properties of the new plastic material can be influenced; in particular, the material properties can be adjusted by appropriate can times.

It will be seen that the plastic material can be used with advantage since a higher heat-expansion coefficient can be achieved than that of the other constructional parts, resulting in a higher pressure, and thus in an excellent sealing action. It is important, in addition, that the plastic material provides a very good re-setting capacity.

For the proposed poly laurin lactam the unit of pressure of the linear expansion coefficient amounts to: 0.8 to $1.0\times10^4$ per degree Celsius at $-60°$ to $+30°$ C., and 1.0 to $1.9\times10^4$ per degree C. at $+30°$ to 100° C.

It should be understood by those skilled in the art that the above disclosure relates only to a preferred, exemplary embodiment of an improved heat exchanger, of which several modifications can be made, with additions, departures and changes, all within the spirit and scope of the present invention.

What I claim is:

1. An improved tube base (1, 2) for a bundle-type heat exchanger and an inner wall of a casing (3) of the exchanger, for cooperation with a tube bundle (4) of the exchanger; the tube base consisting of a poly laurin lactam material that has an elastic return capacity up to about 80%, a unit of thermal expansion coefficient of 0.8 to $1.0\times10^4$ per degree Celsius at $-60°$ to $+30°$ C., and 1.0 to $1.9\times10^4$ per degree Celsius at $+30°$ to $+100°$ C., which unit is higher than that of the tubes in said bundle and of said casing; said bundle being entirely cast at least at one end into said material in a gapless manner; said material also acting as sealing means (17, 18) between said tubes and the tube base, on the one hand, and the tube base and an inner wall of said casing, on the other hand; wherein a contour of a covering face of the tube base, which face is opposite said inner wall, is profiled to have a peripheral curved portion (16) for the formation of at least one sealing edge (17, 18) that forms part of said sealing means.

2. The tube base as defined in claim 1, wherein two spaced-apart sealing edges (17, 18) are provided that flank said curved portion (16), which latter has a concave configuration.

3. The tube base as defined in claim 2, further comprising means, at least partly constituted by said poly laurin lactam material of the tube base (1, 2), with a double function: namely, first, for increasing the pressure of said sealing means (17, 18) between said tubes in the bundle (4) and the tube base, and between the latter and said inner wall of the casing (3) of the heat exchanger, by expansion of the tube base to an extent in excess to the expansion of said tubes as a result of an increase in temperature when the exchanger is heated during its operation; and, second, for allowing said curved portion (16) to take up at least part of the expansion of the tube base upon the temperature increase, between said inner wall and at least one of said sealing edges (17, 18) of the sealing means.

4. The tube base as defined in claim 1, wherein the outer face thereof has therein a recess (20) for a central flange (21) of a hood (9) for the heat exchanger, said flange separating part chambers (22, 23) within said hood, for fluid inlet and outlet purposes.

* * * * *